US011071412B2

(12) United States Patent
Bertani

(10) Patent No.: US 11,071,412 B2
(45) Date of Patent: Jul. 27, 2021

(54) FOOT WASHER

(71) Applicant: Romolo Lorenzo Bertani, Sydney (AU)

(72) Inventor: Alessandro Bertani, Sydney (AU)

(73) Assignee: Romolo Lorenzo Bertani, Sydney (AU)

( * ) Notice: Subject to any disclaimer, the term of this patent is extended or adjusted under 35 U.S.C. 154(b) by 0 days.

(21) Appl. No.: 16/467,245

(22) PCT Filed: Dec. 7, 2017

(86) PCT No.: PCT/AU2017/051345
§ 371 (c)(1),
(2) Date: Jun. 6, 2019

(87) PCT Pub. No.: WO2018/102873
PCT Pub. Date: Jun. 14, 2018

(65) Prior Publication Data

US 2020/0077846 A1 Mar. 12, 2020

(30) Foreign Application Priority Data

Dec. 8, 2016 (AU) ..... 2016905059

(51) Int. Cl.
*A47K 3/022* (2006.01)
*A47K 7/04* (2006.01)
(Continued)

(52) U.S. Cl.
CPC ..... *A47K 3/022* (2013.01); *A47K 7/026* (2013.01); *A47K 7/04* (2013.01); *A47K 10/48* (2013.01); *A61H 35/006* (2013.01)

(58) Field of Classification Search
CPC ..... A61H 35/006; A61H 2035/004; A47K 7/022; A47K 7/026; A47K 7/04
See application file for complete search history.

(56) References Cited

U.S. PATENT DOCUMENTS 3,810,463 A 5/1974 Krummenacher
6,393,633 B2 * 5/2002 Ferber ..... A47K 3/022 4/541.5

(Continued)

FOREIGN PATENT DOCUMENTS

CA 996004 8/1976
CN 202236249 U 5/2012

(Continued)

OTHER PUBLICATIONS

Espacenet English Language Abstract for EP0066555(A2), Dec. 8, 1982.

(Continued)

*Primary Examiner* — Erin Deery
(74) *Attorney, Agent, or Firm* — Tiajoloff & Kelly LLP

(57) ABSTRACT

A device for washing the feet and lower legs of a user comprises a tub for receiving the feet and lower legs of the user; at least one footrest located within the tub for supporting the feet of a user during washing; a fluid supply mechanism for introducing fluid into the tub; one or more rotatable transversely extending cleaning assemblies located above the footrest for washing a user's feet; and one or more rotatable upright cleaning assemblies communicating with the fluid supply mechanism for washing one or both lower legs of the user, wherein each rotatable upright cleaning assembly is carried on a guiding mechanism for moving the one or more rotatable upright cleaning assemblies around a portion of the footrest during a lower leg and foot cleaning cycle.

14 Claims, 7 Drawing Sheets

(51) Int. Cl.

| | |
|---|---|
| ***A47K 10/48*** | (2006.01) |
| ***A61H 35/00*** | (2006.01) |
| ***A47K 7/02*** | (2006.01) |

(56) References Cited

U.S. PATENT DOCUMENTS

| | | | | |
|---|---|---|---|---|
| 2008/0167589 | A1* | 7/2008 | Fung | A61H 23/0254 601/104 |
| 2009/0241257 | A1* | 10/2009 | Malta | A47K 7/024 4/606 |
| 2010/0299828 | A1* | 12/2010 | Shapiro | A47K 3/022 4/622 |
| 2016/0213562 | A1* | 7/2016 | Gathers | A47K 1/04 |
| 2016/0374897 | A1* | 12/2016 | Carey | A47K 3/006 4/568 |

FOREIGN PATENT DOCUMENTS

| | | | | |
|---|---|---|---|---|
| CN | 204500475 | U | | 7/2015 |
| CN | 105213171 | A | * | 1/2016 |
| CN | 105877567 | A | * | 8/2016 |
| DE | 3423045 | A1 | | 1/1986 |
| DE | 102004031058 | A1 | | 1/2006 |
| EP | 0066555 | A2 | | 12/1982 |
| FR | 2198727 | A1 | | 4/1974 |
| FR | 2849588 | A1 | * | 7/2004 ..... A61H 35/006 |

OTHER PUBLICATIONS

Espacenet English Language Abstract for CN204500475(U), Jul. 29, 2015.

Espacenet English Language Abstract for DE102004031058(A1), Jan. 2, 2006.

Espacenet English Language Abstract for DE3423045(A1), Jan. 2, 1986.

Espacenet English Language Abstract for CN 202 236 249 U, May 30, 2012.

* cited by examiner

FOOT WASHER

FIELD OF THE INVENTION

This disclosure relates to a foot washer for washing one or both feet and lower legs of a user.

BACKGROUND OF THE INVENTION

Many people experience difficulties in reaching and manually washing their feet and lower legs for various reasons. These difficulties are usually accentuated if these people take showers rather than baths, since washing feet in a shower usually requires a person to stand on one leg or bend one leg. In most instances, the elderly, pregnant women and those with limited mobility, disabilities, or medical conditions can have difficulty in manually washing their feet and are prone to becoming unstable if washing their feet during showering. In addition, they may also not be able to wash their feet to the required degree of cleanliness resulting in the feet becoming prone to infection.

In some instances, these people will be provided with an assistant who will individually or jointly introduce the feet into a pan where they will be washed. The assistant will then remove the feet from the pan and manually dry the person's feet. However, this procedure can be a time consuming process for the assistant, and many people may not even have access to an assistant some or most of the time. In certain instances, a person may also encounter difficulties in washing their accessible lower legs.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

According to the present invention, there is provided a device for washing the feet and lower legs of a user, comprising:

a tub for receiving the feet and lower legs of the user;

at least one footrest located within the tub for supporting the feet of a user during washing;

a fluid supply mechanism for introducing fluid into the tub;

one or more rotatable transversely extending cleaning assemblies located above the footrest for washing a user's feet; and one or more rotatable upright cleaning assemblies for washing one or both lower legs of the user, wherein each rotatable cleaning assembly is carried on a guiding mechanism for moving the one or more cleaning assemblies around a portion of the footrest during a lower leg and foot cleaning cycle.

At least one of the rotatable upright cleaning assemblies and rotatable transversely extending cleaning assemblies may communicate with the fluid supply mechanism.

The fluid supply mechanism may be a liquid and air supply mechanism and at least one of the transversely extending and upright cleaning assemblies may be connected to the liquid and air supply mechanism and configured to selectively dispense pressurized liquid and air through the cleaning assemblies for washing the feet and lower legs of a user.

At least one of the transversely extending and upright cleaning assemblies may also be connected to an air source and configured to selectively dispense compressed air through a manifold and the cleaning assemblies for drying the feet and lower legs of a user.

The device may also include a selector means for selectively dispensing liquid or compressed air, wherein the selector means includes a selector valve for diverting liquid or air to the one or more transversely extending cleaning assemblies or rotatable upright cleaning assemblies.

The guiding mechanism may also include a rotary arm fluidly and pivotally coupled to an intermediate shaft. The intermediate shaft may be connected to an actuator and transmission means for driving the rotary arm around a portion of the footrest during the lower leg and foot cleaning cycle.

The intermediate shaft may be further connected to the selector valve through a plenum for transmitting air and liquid to the upright cleaning assemblies via the intermediate shaft and rotary arm.

The selector valve may also be connected to a pumping system and an air blower through separate plenums for respectively transmitting liquid and air to the selector valve. The pumping system may further comprise a pump and a tank, the pump being configured to pump liquid stored in the tank to the selector valve. The pump may also be used to pump waste liquid from the tub.

The transversely extending or upright cleaning assemblies may also include one or more of: a brush attachment, a sponge attachment; a liquid jet attachment; and an air dryer attachment. One or more of these attachments may also be removable and interchangeable.

The device may also comprise a controller configured to selectively control the operation of the one or more cleaning assemblies. This controller may also be configured to wirelessly transmit an emergency signal.

The tub of the device may also further comprise one or more doors located in a side wall of the tub.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

DETAILED DESCRIPTION OF THE EMBODIMENTS

Figure 1A:
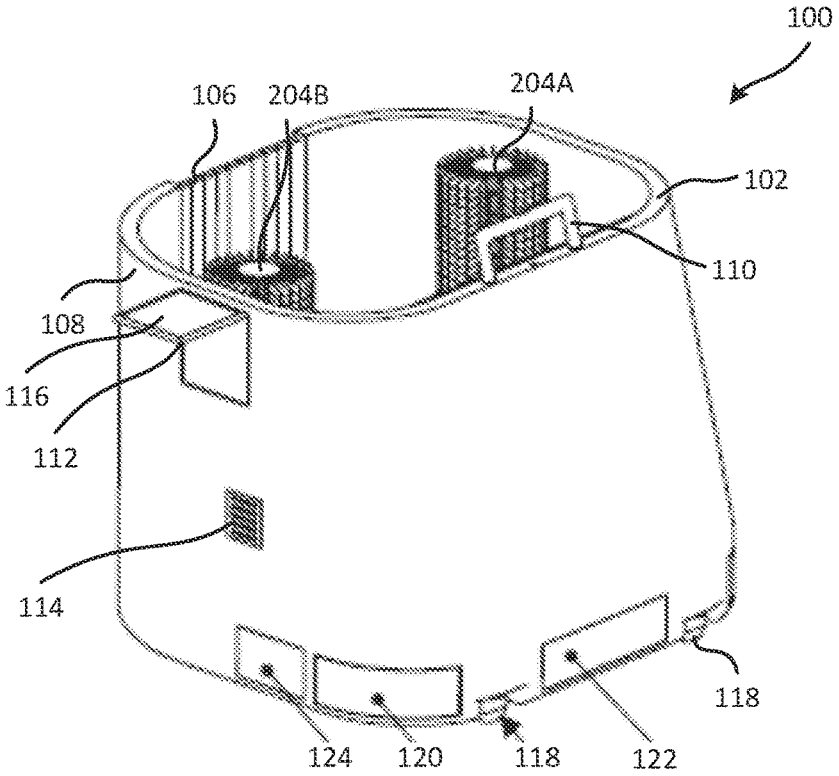
FIG. 1A is a rear perspective view of an embodiment of a foot washer.
Figure 1B:
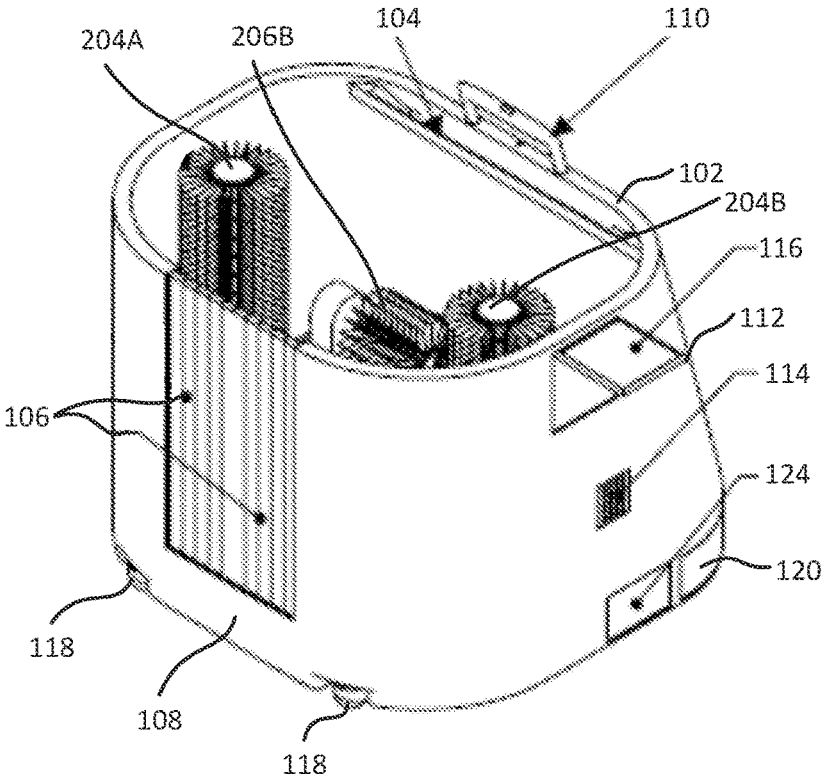
FIG. 1B is a front perspective view of the foot washer of FIG. 1.
Figure 2:
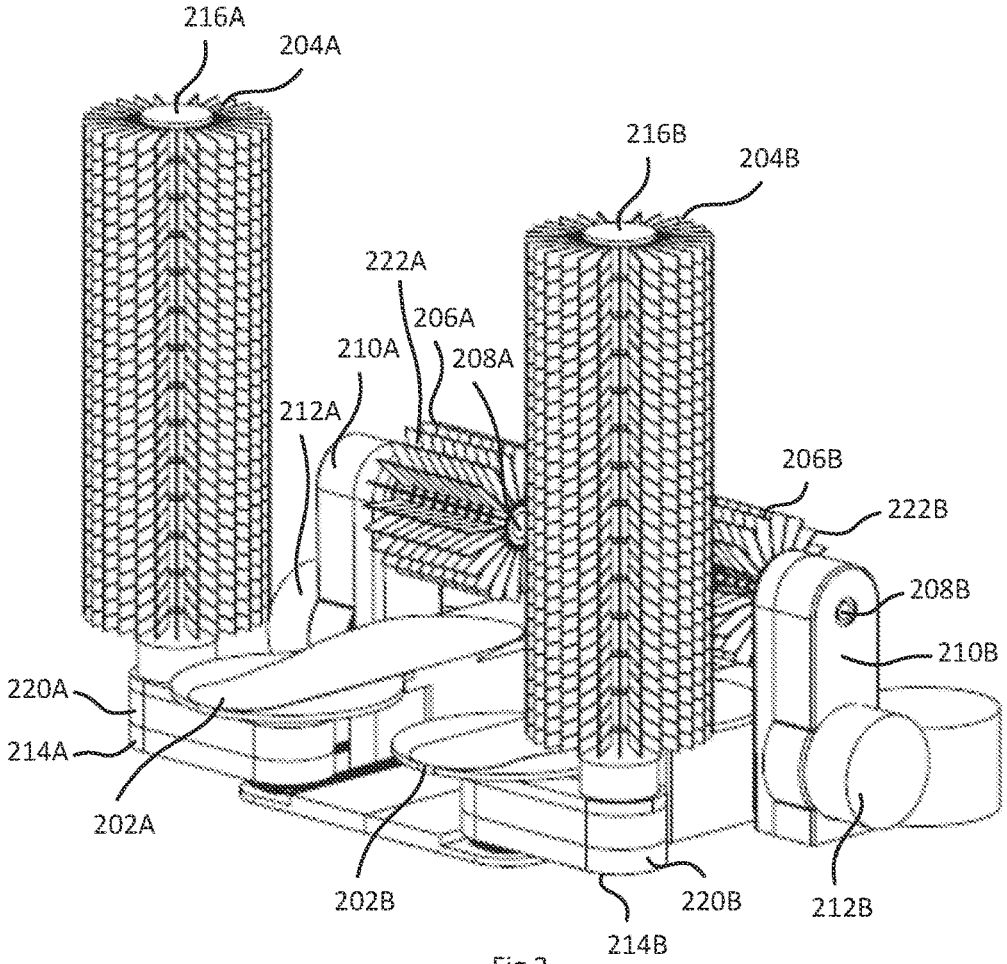
FIG. 2 is a rear perspective view of a plurality of cleaning assemblies shown in FIGS. 1A-1B.

Referring to FIGS. 1A-1B and 2, an embodiment of a foot washer 100 for washing the feet and lower legs of a user is shown. As shown in FIGS. 1A-1B and 2, the foot washer 100 includes a tub 102 for receiving the feet and lower legs of a user. In the embodiment shown in FIGS. 1A-1B, the tub 102 is large enough to receive and accommodate both feet and lower legs of a user for concurrent or sequential washing of a user's feet and lower legs. In another embodiment, the tub 102 is large enough to receive and accommodate a single foot and lower leg of a user for sequential washing of one or both feet and lower legs of a user. As shown in FIGS. 1A-1B, the tub 102 is provided with one or more access doors 106 located on a side wall 108 of the tub 102 to enable a user to access and remove their feet and lower legs from the foot washer 100. The one or more access doors 106 may be manually operated or electronically operated by a user. The tub 102 may include a handle 110 and casters 118 for moving the foot washer, as shown in FIGS. 1A-1B.

Figure 3:
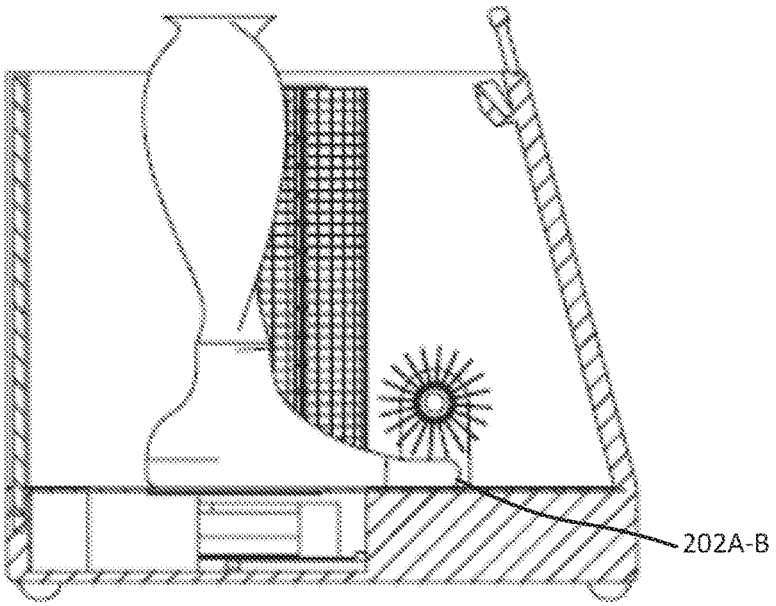
FIG. 3 is a cross section of the foot washer shown in FIGS. 1A-1B.
Figure 4:
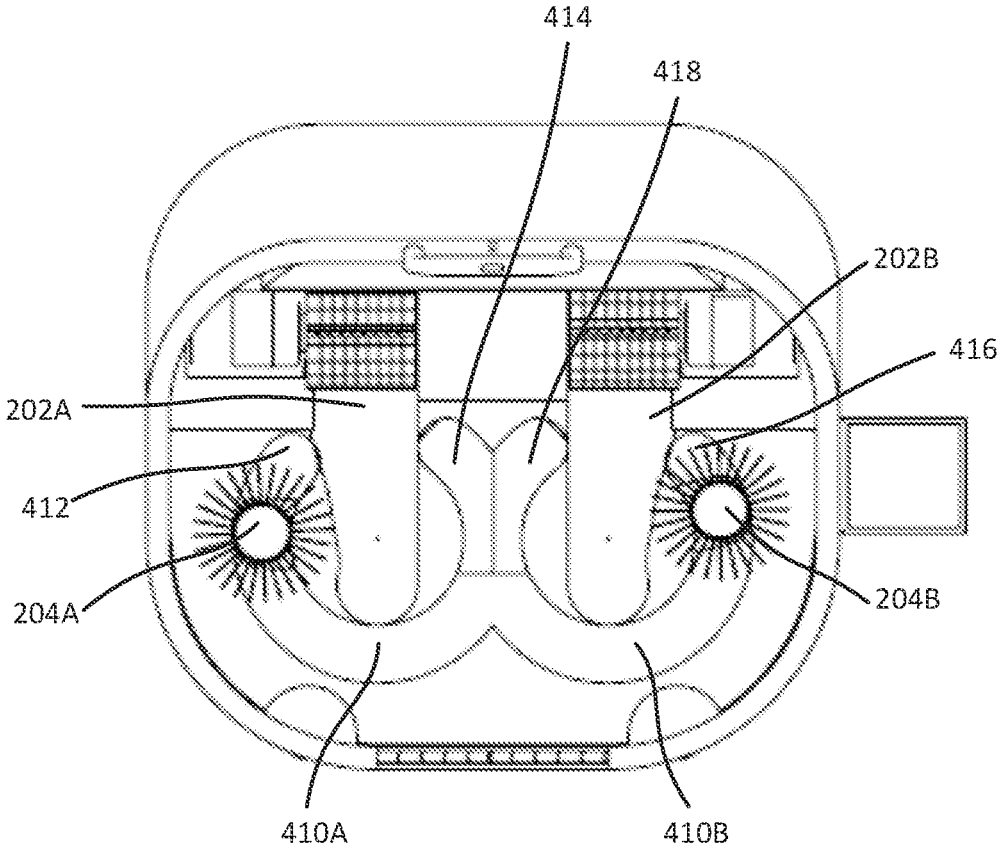
FIG. 4 is a top view of the foot washer of FIG. 1.

Located within the tub 102 is a right and left footrest 202A-202B for supporting the feet and lower legs of a user during washing, as shown in FIG. 3. The footrests may also aid in maintaining the user's feet and lower legs in a predetermined position during washing, as shown in FIG. 4. In another embodiment, the footrest may be a single footrest capable of receiving both feet of the user. The footrest may be coated in a non-slip coating to prevent slippage and aid in the stability of the user during washing of their feet and lower legs.

The foot washer 100 also includes a liquid and air supply mechanism for introducing liquid and air into the tub. Liquid or air may also be introduced into the tub by a liquid or air supply mechanism, respectively. The liquid supply mechanism introduces water into the tub, which can include a cleaning solution, for example, soap. As shown in the embodiment of FIG. 1B, the liquid supply mechanism includes a plenum 104 into which water is pumped to produce a waterfall cascade that introduces water into the tub. The transversely extending cleaning assemblies 206A-206B and/or upright cleaning assemblies 204A-204B also act as liquid and air supply mechanisms, described in further detail below. However, the person skilled in the art would appreciate that the liquid and air supply mechanism could be any mechanism that can introduce liquid and air into the tub, for example, via a pipe communicating with the tub.

The foot washer 100 also includes two rotatable transversely extending cleaning assemblies 206A-206B and two rotatable upright cleaning assemblies 204A-204B, as shown in FIG. 2. In another embodiment, the foot washer 100 includes a single rotatable transversely extending cleaning assembly for washing a user's feet and a single rotatable upright cleaning assembly for washing one or both lower legs and feet of a user.

The rotatable transversely extending cleaning assemblies or the rotatable upright cleaning assemblies may comprise one or more of: a rotary brush attachment 500; a rotary sponge attachment; a rotary liquid jet attachment; or a rotary air dryer attachment. The rotary brush, sponge, liquid jet or air dryer attachments may be removable and interchangeable. The rotary motion of the one or more transversely extending or upright cleaning assemblies may also be selectively controlled in an either clockwise or anticlockwise motion.

Figure 5:
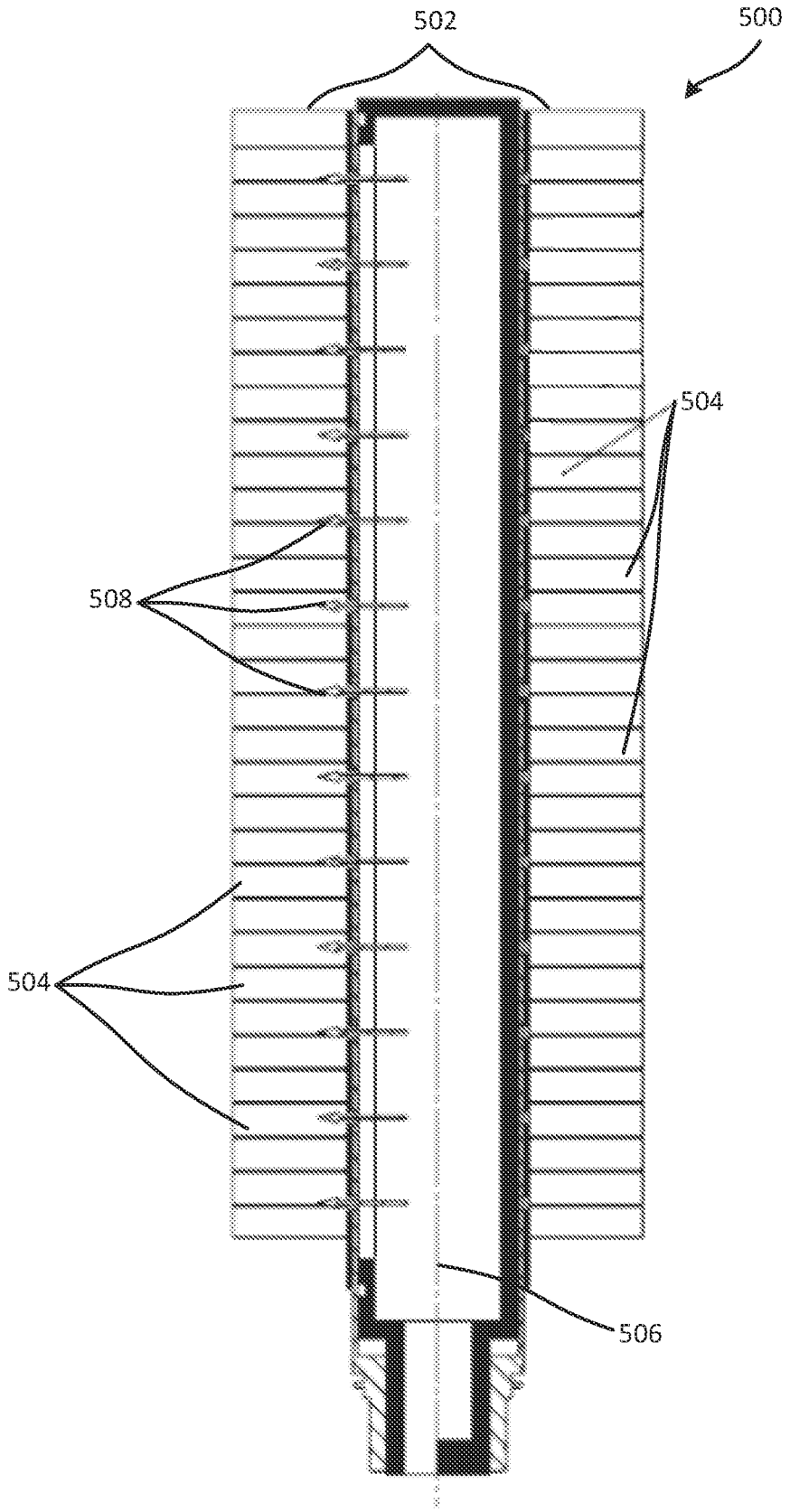
FIG. 5 is a cross section of a rotatable upright cleaning assembly shown in FIG. 2.
Figure 6:
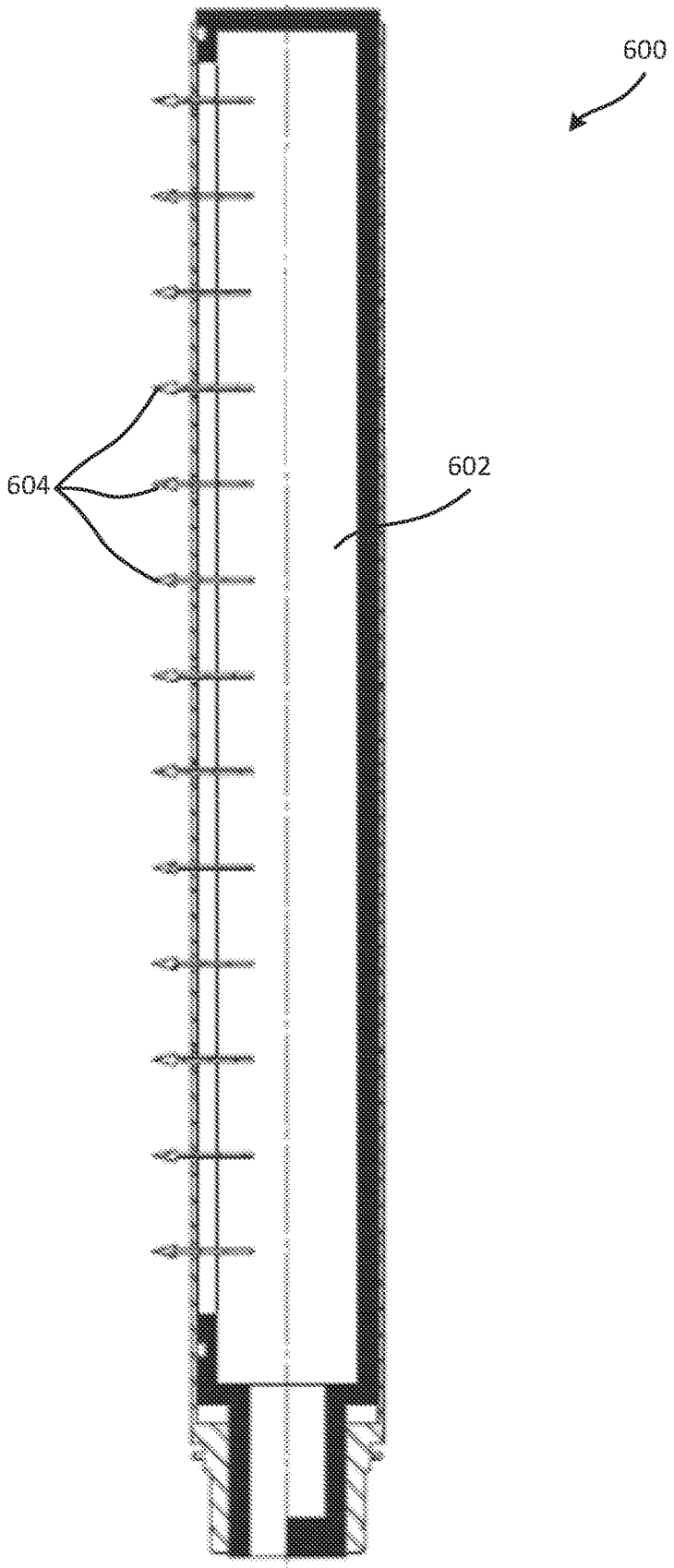
FIG. 6 is a cross section of a rotatable upright liquid jet or air dryer attachment for use with the foot washer of FIGS. 1-4.

An example of an interchangeable rotary brush attachment 500 is shown in FIG. 5 and includes a brush 502 comprising a plurality of bristles 504 located on an upright liquid and air manifold 506 comprising a plurality of apertures 508 for dispensing air or liquid through the cleaning assemblies. An example of an interchangeable rotary liquid jet or air dryer attachment 600 is shown in FIG. 6 and includes an upright manifold 602 comprising a plurality of apertures 604 for dispensing pressurized liquid or air through the cleaning assemblies.

It will also be appreciated that any combination and number of interchangeable rotary brush, sponge, liquid jet and air dryer attachments can be used. For example, a rotary sponge attachment may operate on the right upright shaft, while a rotary brush attachment may operate on the left upright shaft.

In another embodiment, the plurality of bristles 504 forming the transversely extending or upright brushes 500 are removable to expose each transversely extending or upright manifold 506 that contains a plurality of apertures 508 disposed thereon. Pressurised liquid is capable of being dispensed through each of these transversely extending or upright manifolds 506 in order to provide a massaging action to the user. Compressed air is also capable of being dispensed through each of the transversely extending or upright manifolds 506 in order to dry a user's feet and lower legs.

As shown in FIG. 2, each transversely extending cleaning assembly 206A-206B comprises a brush attachment 222A, 222B arranged on a transversely extending shaft 208A-208B located above the right and left footrest 202A-202B, respectively. Each shaft 208A-208B is connected to a trunnion 210A or 210B. Within each trunnion 210A, 210B is an actuator 212A, 212B that rotates the shaft 208A, 208B and brush attachments 222A or 222B and a transmission mechanism (not shown) to transmit the rotary motion to the shaft 208A, 208B. In another embodiment, each trunnion 210A, 210B is configured to be driven, by the actuators 212A, 212B, along a track disposed parallel to each footrest 202A, 202B in order to wash the user's feet. In another embodiment, the transversely extending brushes 206A, 206B are arranged on a single transversely extending shaft extending over each footrest 202A, 202B.

Figure 7:
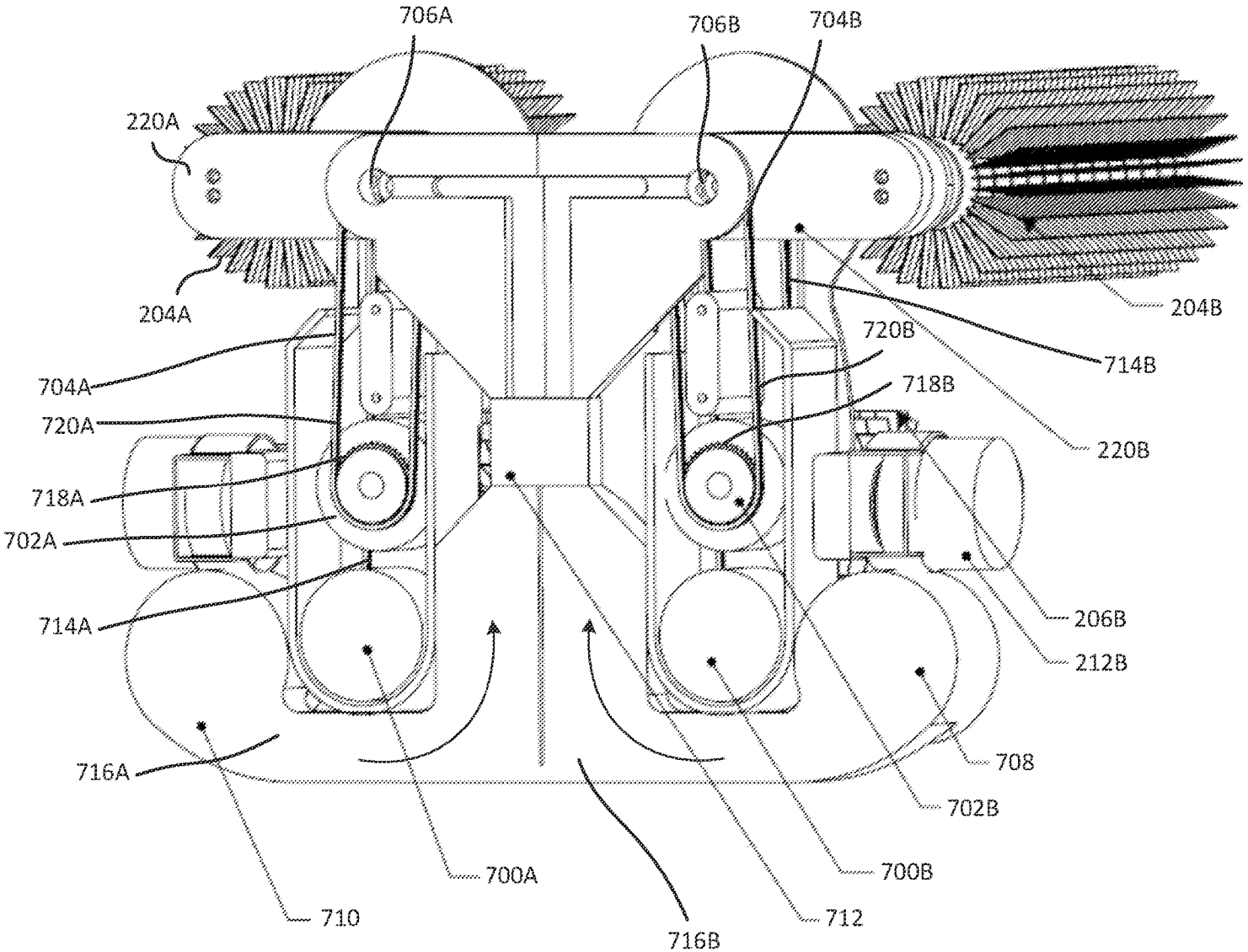
FIG. 7 is a rear view of the cleaning assemblies shown in FIG. 2.

As shown in FIG. 2, the rotatable upright cleaning assemblies 204A, 204B are arranged on rotatable upright shafts 216A, 216B for washing both lower legs and feet of a user. Each rotatable upright shaft 216A, 216B is connected to an actuator 700A, 700B that rotates the shaft and brushes and a transmission mechanism 714A, 714B including a transmission belt and sprockets (not shown) to transmit the rotary motion to the shaft, as shown in FIG. 7. The actuators 700A, 700B are in the form of a motor, for example, a fluid immersible electric motor.

The rotatable upright cleaning assemblies 204A, 204B are also carried on a guiding mechanism 214A, 214B for moving the cleaning assemblies 204A, 204B around a portion of the footrest 410 during a lower leg and foot cleaning cycle. As shown in FIGS. 2 and 7 the guiding mechanism 214A, 214B includes a rotary arm 220A, 220B driven by an actuator 702A, 702B and a transmission mechanism 704A, 704B, as shown in FIG. 7. Each transmission mechanism includes a transmission belt 720A, 720B and sprockets 718A, 718B to cause each rotary arm 220A, 220B to move around a portion of each footrest 410A, 410B by pivoting on each intermediate shaft 706A, 706B located below each footrest 202A, 202B. In another embodiment, the guiding mechanism may include a track surrounding a portion of the footrest for engaging with a lowermost portion of the upright shaft, and/or an associated rack and pinion arrangement.

In the instance where two or more upright cleaning assemblies are used, the guiding mechanism can operate these assemblies either concurrently or sequentially. In the two brush embodiment shown in FIG. 4, cleaning assembly 204A is configured to wash a user's lower left leg and foot by moving from a first position 412 adjacent to the left side of the left footrest to a second position 414 adjacent to the right side of the left footrest 202A and return to the first position 412. In addition, cleaning assembly 204B is configured to wash a user's lower right leg and foot by moving from a first position 416 adjacent to the right side of the right footrest 202B to a second position 418 adjacent to the left side of the right foot rest and return to the first position 416. In an embodiment where a single upright brush is used, the upright brush is configured to wash a user's lower legs and feet by moving from a first position adjacent to the left or right side of a footrest to an intermediate position located between the user's lower legs and feet and to a second position located adjacent to the right or left side of the footrest, respectively, before returning to the first position via the intermediate position.

The operation of one or more upright cleaning assemblies 204A, 204B may occur concurrently or sequentially with the operation of the one or more transversely extending cleaning assemblies 206A, 206B. The operation of the one or more upright cleaning assemblies 204A, 204B may alternatively occur without operation of the one or more transversely extending brushes 206A, 206B. With reference to FIG. 2, in one mode, the right and left upright cleaning assemblies 204A, 204B operate concurrently or sequentially with the operation of the right and left transversely extending cleaning assemblies 206A, 206B. In another mode, the right or left upright cleaning assembly 204A, 204B operates concurrently or sequentially with the right or left transversely extending assembly 206A, 206B, respectively. In another mode, the right and left upright cleaning assemblies 204A, 204B operate without operation of the right or left transversely extending cleaning assemblies 206A, 206B. In another mode, the right or left upright cleaning assemblies 204A, 204B operate without operation of the right or left transversely extending cleaning assemblies 206A, 206B. In another mode, the right and left transversely extending cleaning assemblies 206A, 206B operate without the operation of the right or left upright cleaning assemblies 204A, 204B.

In yet another mode, the right or left transversely extending cleaning assemblies 206A, 206B operate without the operation of the right or left upright cleaning assemblies 204A, 204B. In yet another mode, the right transversely extending cleaning assembly 206B operates concurrently or sequentially to the operation of the left upright cleaning assembly 204A. In yet another mode, the left transversely extending cleaning assembly 206A operates concurrently or sequentially to the operation of the right upright cleaning assembly 204B. This operation of the transversely extending cleaning assemblies 206A, 206B and the upright cleaning assemblies 204A, 204B can also be controlled via a manual or pre-programmed controller, as described in further detail below.

Each transversely extending or upright cleaning assembly may be connected to the liquid supply mechanism and, in one mode, configured to dispense liquid through a manifold and the cleaning assembly for washing one or both feet and lower legs of a user. In another mode, each transversely extending or upright cleaning assembly is connected to the air supply mechanism and, in one mode, configured to dispense compressed air through a manifold and the cleaning assembly for drying one or both feet and lower legs of a user.

Figure 8A:
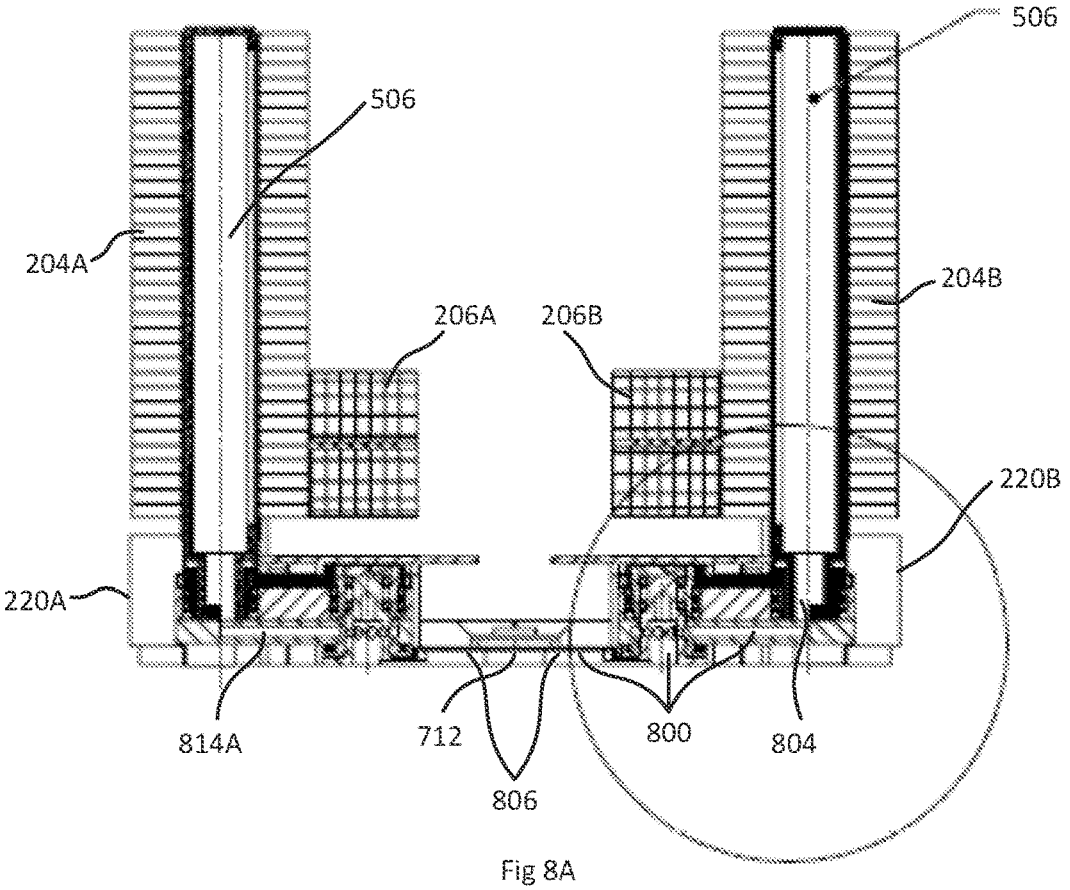
FIG. 8A is a cross section of the cleaning assemblies shown in FIG. 2.
Figure 8B:
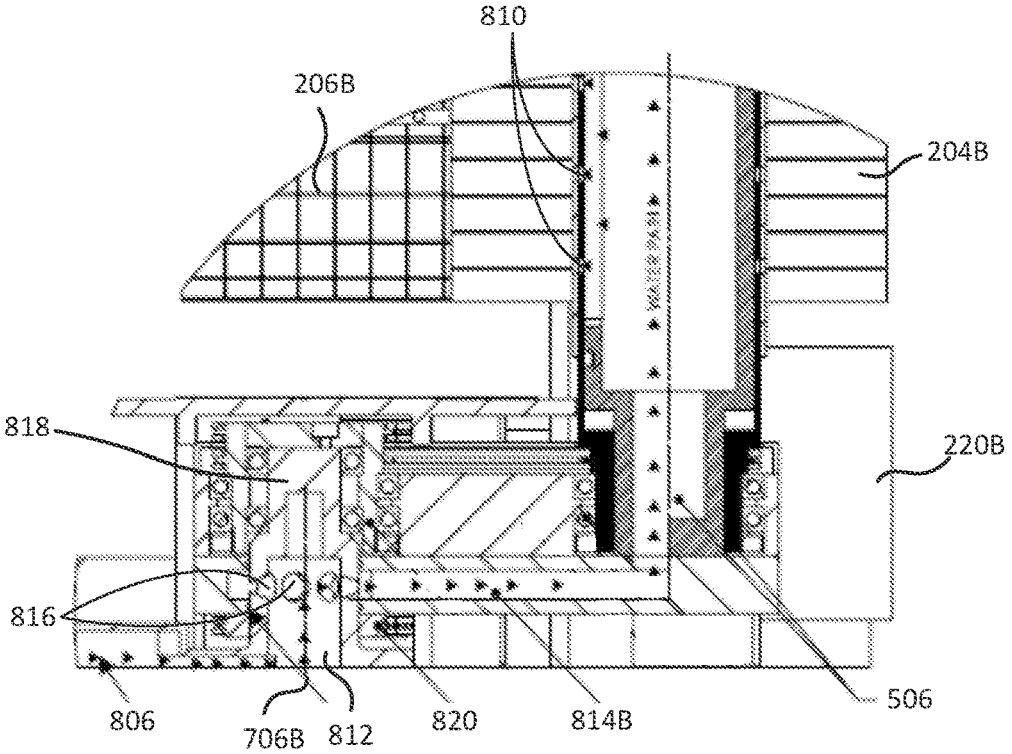
FIG. 8B is an enlarged view of the inset shown in FIG. 8A.

In the embodiment shown in FIGS. 7, 8A-8B, the liquid and air supply mechanism 800 includes a selector valve or a valve diverter 712 for selectively diverting liquid or air through passages 806 located at the base of the tub 102 and into each rotary arm 220A, 220B or through the interior of each trunnion 210A, 210B (not shown) and into the upright 204A, 204B 244B or transversely extending 206A, 206B cleaning assemblies, respectively. Liquid or air is conveyed through conduits 806 and 812 located within each intermediate shaft 706A, 706E of each rotary arm 220A, 220B or trunnion 210A, 210B. Each intermediate shaft 706A, 706B is located within a housing 818 and includes one or more circular apertures 816 located on its exterior surface for communicating with each supply conduit 814A, 814B and for transmitting liquid or air to the supply conduits 814A, 814B. Each supply conduit 814A, 814B is connected to the manifold 506 located within each upright cleaning assembly 204A, 204B. Each manifold comprises a plurality of apertures 810 for distributing liquid or air through each upright cleaning assembly 204A, 204B. Located between each housing 818 and supply conduits 814A, 814B is a seal 820 for preventing liquid or air from escaping the housing. Air and liquid may alternatively be distributed through separate supply conduits and separate manifolds.

Air or liquid may be distributed from an air blower 710 and/or from a pumping system 120 through separate plenums 716A, 716B to the valve diverter 712. The valve diverter may also be configured as an overflow valve for preventing overflow of liquid through the liquid supply mechanism and cleaning assemblies.

As shown in FIG. 1, the foot washer 100 may further comprise a controller 112 located on the tub 102. The controller 112 is configured to control the operations or functions of the foot washer 100. For example, the controller 112 is configured to control the operation of one or more of: the one or more transversely extending 206A, 206B or upright 204A, 204B cleaning assemblies; dispensing of liquid through each cleaning assembly; and dispensing of air through each cleaning assembly. For example, the controller 112 may control the rotation speed and rotary motion of the cleaning assemblies.

The controller 112 measures the temperature of the liquid or air dispensed into the tub 102 via a liquid temperature control circuit. The controller 112 may be configured to sound an alarm via a speaker 114 shown in FIGS. 1A-1B if the liquid or air exceeds a predetermined temperature.

The controller 112 may be connected to a timer for measuring the time of one or more operations or functions of the foot washer 100. The timer is used to start and end one or more operations or functions of the foot washer 100. For example, the timer and controller 112 may be used to operate the liquid supply mechanism 104 for 5 seconds, and after this time has expired, operate the transversely extending 206A, 206B or upright 204A, 204B cleaning assemblies for 10 seconds.

The controller 112 may also be configured to wirelessly communicate with an external party, for example, by transmitting an emergency signal. The controller 112 may also be configured to wirelessly communicate with mobile electronic devices, such as a mobile phone or tablet. This wireless communication enables the foot washer 100 to be remotely operated. The controller 112 may be connected to a display screen 116 for displaying one or more of: temperature; time; operation settings; and an emergency response button. The controller may also be a manual remote controller that can be housed in a holder 124 located within the tub.

The foot washer 100 may be a mobile unit capable of being relocated to a location desired by the user. As shown in FIGS. 1A and 1B, the foot washer 100 is provided with one or more casters 118 located on an underside of the tub 102 for relocating the device to a location desired by the user.

When the foot washer 100 is a mobile unit, the liquid supply source 708 includes a pumping system 120 including a pump and a tank, the pump being configured to pump liquid stored in the tank to the liquid supply mechanism. In an embodiment, the liquid in the tub 102 can be recirculated by the pump pumping liquid from the tub 102 through an outlet located in the tub, for example, a drain and into the tank. The pump may also pump waste liquid from the tub 102 and into the tank for later disposal. The air supply source 710 may also include a fan or blower driven by batteries that may, for example, be located in a battery holder 122 of the tub 102, as shown in FIG. 1B. In another embodiment, liquid from the tub 102 is manually drained by the user.

In another embodiment, the foot washer 100 may be a fixed unit connected to a fixed liquid inlet pipe. A pump may also be provided for pumping liquid from this fixed inlet pipe to the liquid supply mechanism and for pumping liquid from the tub 102 to a fixed outlet pipe, for example, a sewage pipe. This liquid may be pumped from the tub through an outlet located in the tub, for example, a drain. The air blower 710 may also be connected and driven by a mains electricity supply. In another embodiment, air and liquid could be supplied by one or more additional units connected to the fixed or mobile foot washer.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A device for washing feet and lower legs of a user, comprising:

a tub for receiving the feet and lower legs of the user;

at least one footrest located within the tub configured to support the feet of the user during washing;

one or more rotatable transversely extending cleaning assemblies located above the at least one footrest and configured to wash the user's feet; and one or more rotatable upright cleaning assemblies configured to wash one or both lower legs of the user, wherein each rotatable upright cleaning assembly includes a manifold mounted on a rotary arm driven by an actuator and a transmission mechanism moving the upright cleaning assembly around a portion of the at least one footrest during a lower leg and foot cleaning cycle; and a fluid supply mechanism including for each manifold a respective conduit connected thereto, wherein each manifold has a plurality of apertures disposed thereon that dispense liquid and/or air to the feet and lower legs of the user.

2. The device of claim 1, wherein the fluid supply mechanism includes a selector valve that selectively dispenses the liquid or the air through at least one of the one or more transversely extending cleaning assemblies and/or the one or more upright cleaning assemblies so as to wash the feet and lower legs of a user.

3. The device of claim 2, wherein the selector valve is connected to a pumping system and an air blower through separate plenums that transmit, respectively, liquid and air to the selector valve.

4. The device of claim 3, wherein the pumping system comprises a pump and a tank, the pump being configured to pump liquid stored in the tank to the selector valve.

5. The device of claim 4, wherein the pump is configured to pump waste liquid from the tub.

6. The device of claim 2, wherein the selector valve functions as an overflow valve that prevents overflow of fluid through the fluid supply mechanism.

7. The device of claim 1, wherein each rotary arm is pivotally coupled to an intermediate shaft connected to the actuator and the transmission mechanism.

8. The device of claim 1, wherein at least one of the one or more transversely extending cleaning assemblies and at least one of the one or more upright cleaning assemblies include at least one of:

a brush attachment;

a sponge attachment;

a liquid jet attachment; and an air dryer attachment.

9. The device of claim 8, wherein the at least one attachment is removable and interchangeable.

10. The device of claim 1, further comprising a controller having a control circuit configured to selectively control the operation of at least one of the one or more transversely extending cleaning assemblies and/or one or more upright cleaning assemblies.

11. The device of claim 10, wherein the controller is also configured to wirelessly transmit an emergency signal.

12. The device of claim 10, wherein the controller is also configured to transmit a wireless signal to a receiver of a mobile electronic device.

13. The device of claim 10 wherein the controller is configured to sound an alarm via a speaker located in a sidewall of the tub if the liquid or air exceeds a predetermined temperature.

14. The device of claim 1, wherein the tub further comprises at least one door located in a side wall of the tub.

* * * * *